US006158530A

United States Patent [19]

Bowen et al.

[11] Patent Number: 6,158,530

[45] Date of Patent: Dec. 12, 2000

[54] HAND-HELD SMOKER'S DEVICE FOR SIDESTREAM SMOKE CONTROL

[75] Inventors: Larry Bowen, Orangeville; Stanislav M. Snaidr, Mississauga, both of Canada

[73] Assignee: 1149235 Ontario Inc., Canada

[21] Appl. No.: 09/171,907

[22] PCT Filed: May 2, 1997

[86] PCT No.: PCT/CA97/00297

§ 371 Date: Sep. 26, 1999

§ 102(e) Date: Sep. 26, 1999

[87] PCT Pub. No.: WO97/41744

PCT Pub. Date: Nov. 13, 1997

[30] Foreign Application Priority Data

May 2, 1996 [GB] United Kingdom ..... 9609177

[51] Int. Cl.[7] ..... A24D 1/12

[52] U.S. Cl. ..... 175/131; 131/187; 131/201; 131/202; 131/330

[58] Field of Search ..... 131/175, 187, 131/201, 202, 215.2, 329, 330

[56] References Cited

U.S. PATENT DOCUMENTS 4,637,407 1/1987 Bonanno ..... 131/175
4,790,332 12/1988 Wallace ..... 131/175
4,993,435 2/1991 McCann ..... 131/330
5,160,518 11/1992 Vega ..... 55/385.8
5,495,859 3/1996 Bowen ..... 131/202
5,497,791 3/1996 Bowen ..... 131/175
5,529,078 6/1996 Rehder ..... 131/175
6,012,459 1/2000 Keefe ..... 131/185

*Primary Examiner*—James Derrington
*Assistant Examiner*—Mark Halpern
*Attorney, Agent, or Firm*—Banner & Witcoff, Ltd.

[57] ABSTRACT

A cigarette combustion unit for the use in a hand-held cigarette smoke filtering device for filtering sidestream smoke emitted from a cigarette burning in the unit comprising: i) an elongate closed combustion chamber for a burning cigarette, a lower wall portion of the combustion chamber at least having an air porous portion to permit air to enter the combustion chamber, ii) a cigarette holder in an end of the combustion chamber for holding a cigarette in the combustion chamber with its burning end spaced from chamber interior wall surfaces, and iii) a sidestream smoke outlet in the end above the cigarette holder.

4 Claims, 7 Drawing Sheets

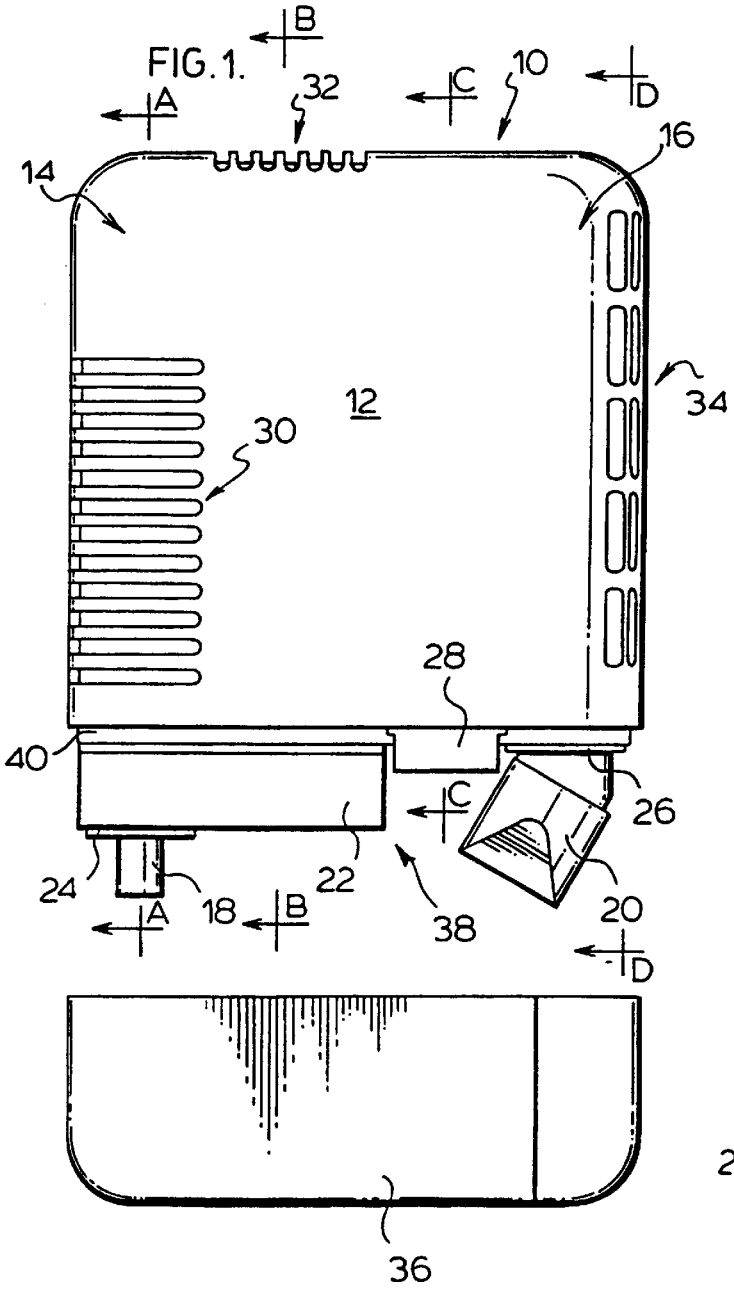
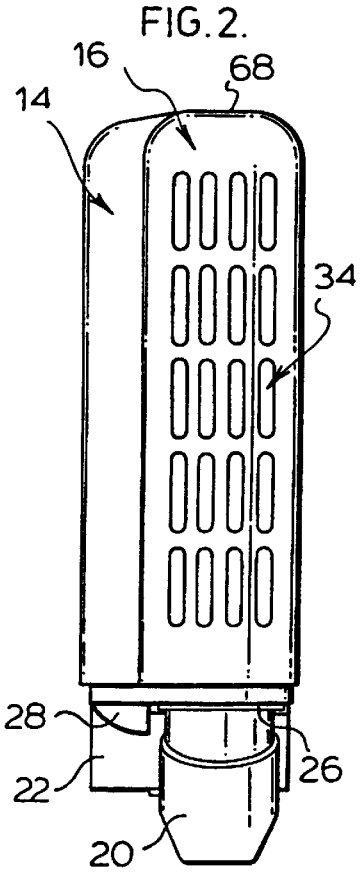
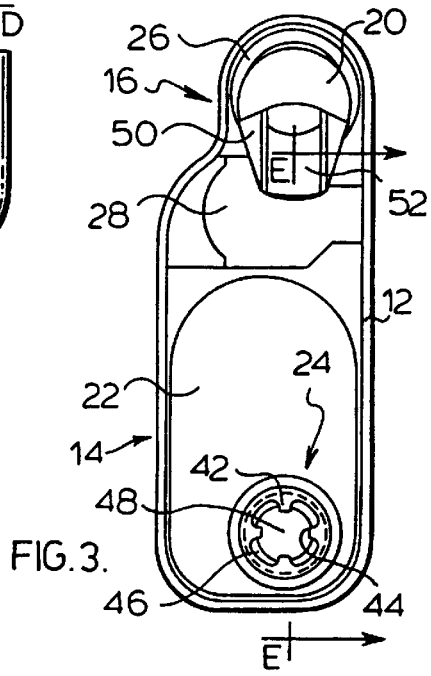
FIG. 3.

FIG. 10. A-A
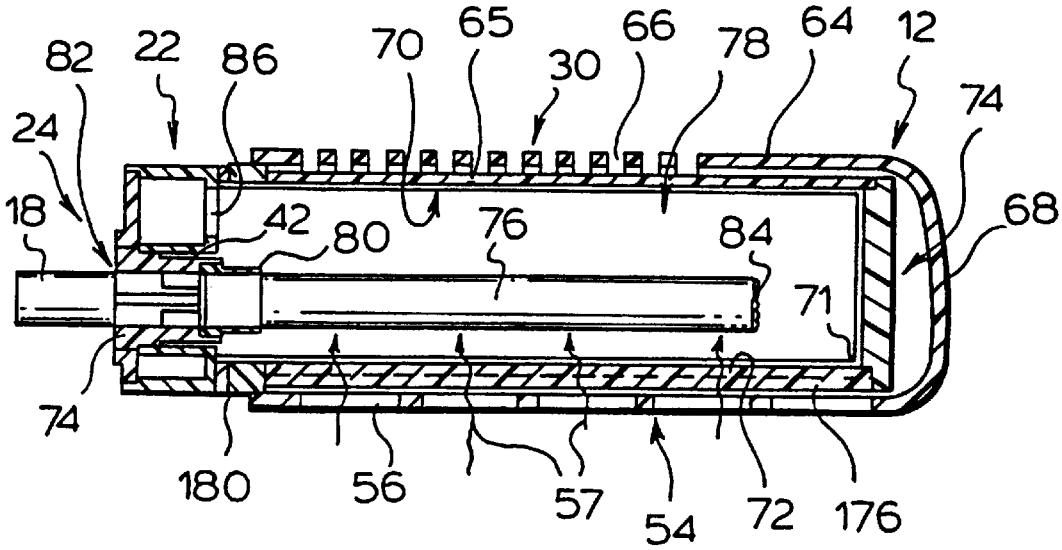
FIG. 11. B-B
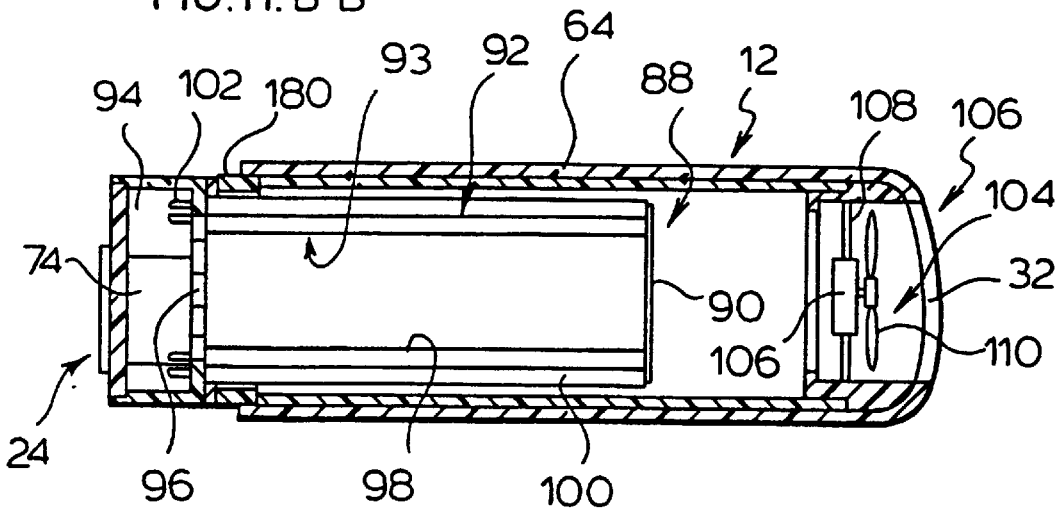

FIG.12. E-E
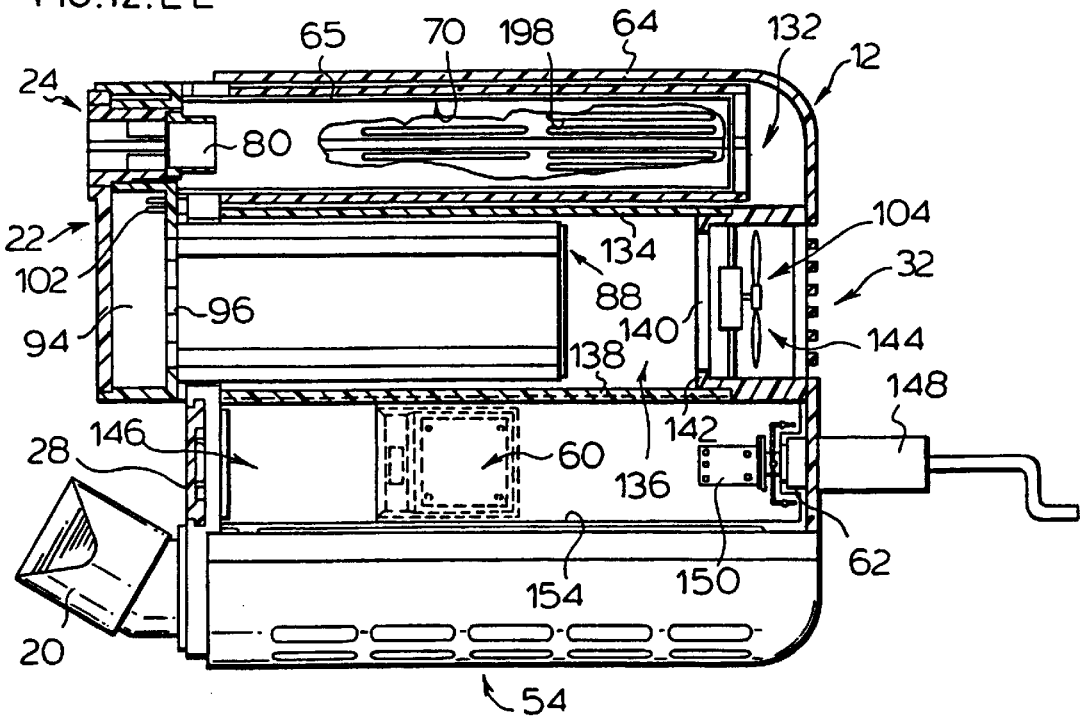
FIG.13. C-C
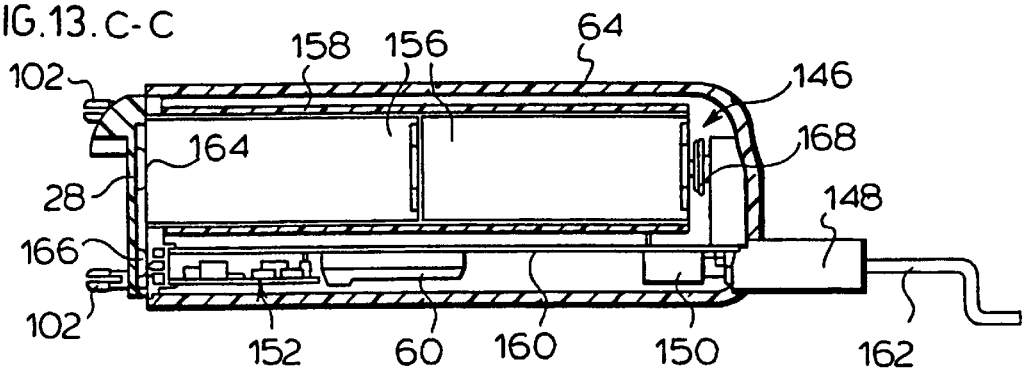
FIG.14. D-D
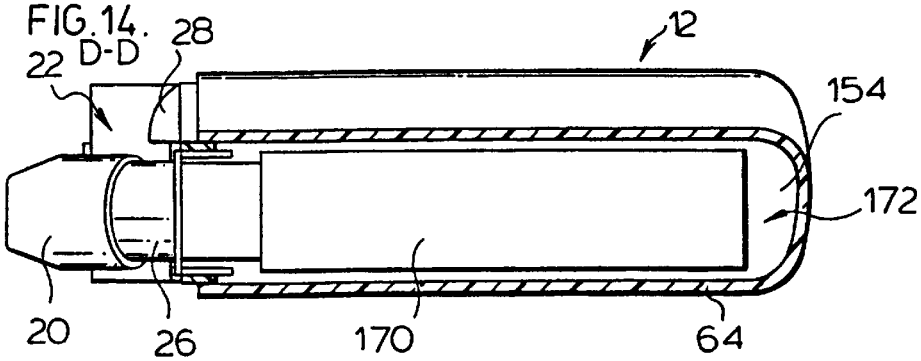

FIG.15.
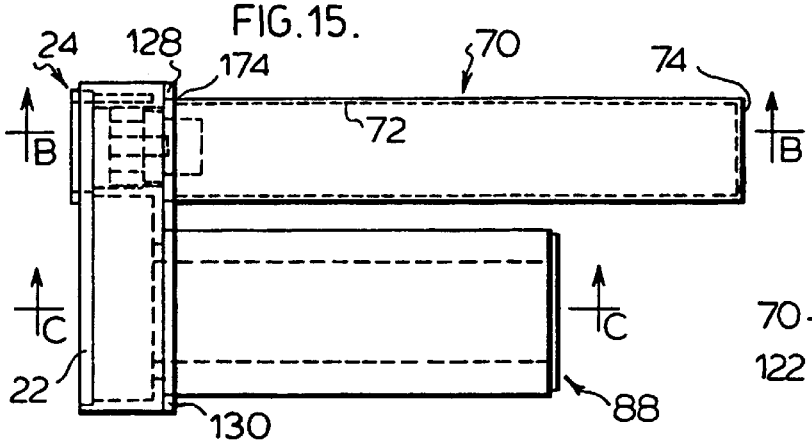
FIG.16.
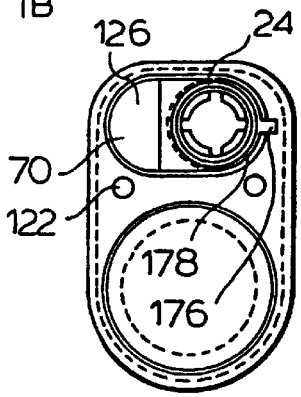
FIG.18.
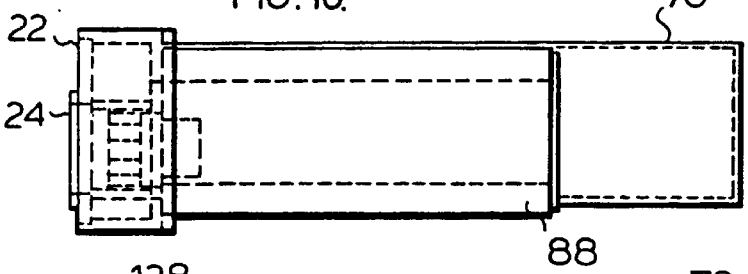
FIG.19. A-A
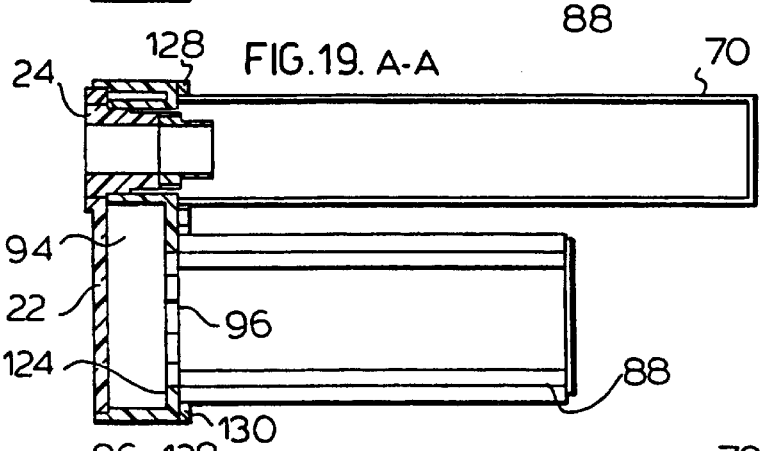
FIG.17.
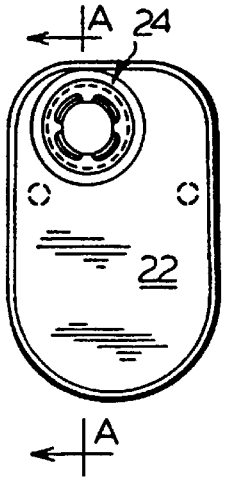
FIG.20.B-B
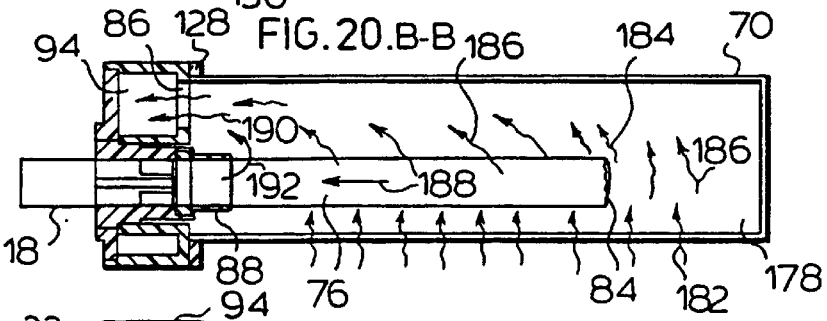
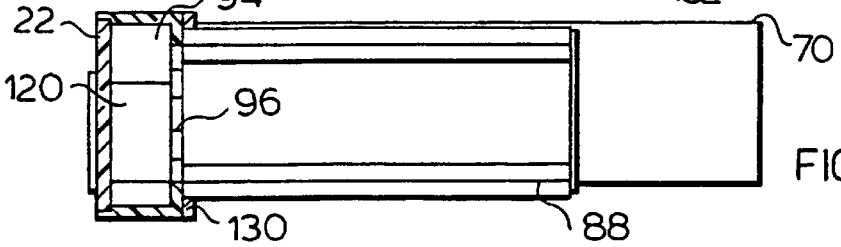
FIG.21.C-C FIG. 30.
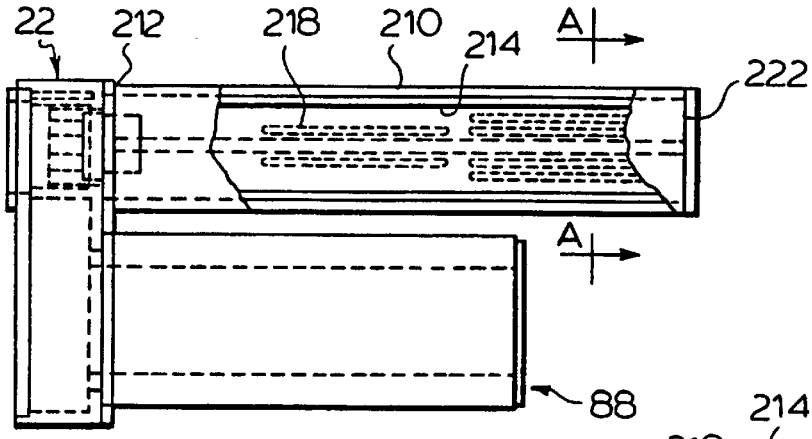
FIG. 31. A-A
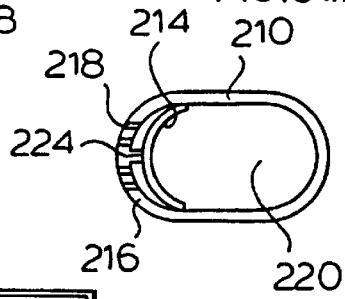
FIG. 32.
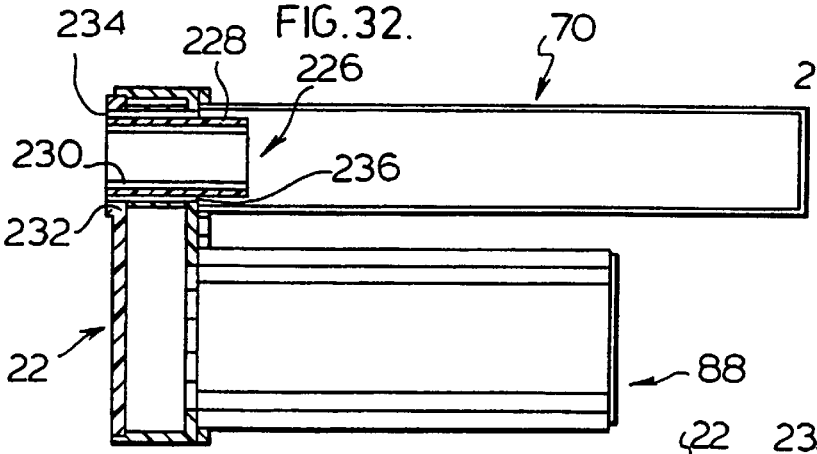
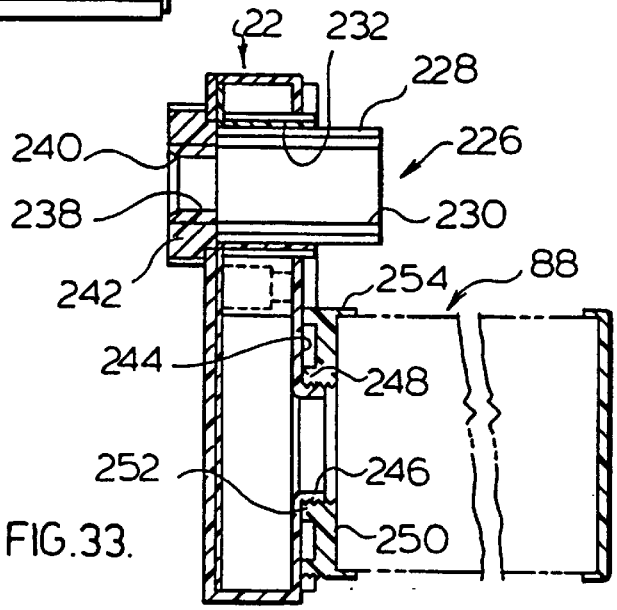
FIG. 33.

HAND-HELD SMOKER'S DEVICE FOR SIDESTREAM SMOKE CONTROL

FIELD OF THE INVENTION

This invention relates to a hand-held smoker's device for controlling sidestream smoke and optionally exhale smoke emitted while smoking a cigarette.

BACKGROUND OF THE INVENTION

The pleasure of cigarette smoking emits cigarette smoke commonly referred to as secondary cigarette smoke which some people find objectionable. Cigarette smoker's in consideration of these people, have taken steps to avoid smoking in areas where secondary smoke may be found to be objectionable. In addition, in certain jurisdictions restrictions have been introduced to ensure that secondary smoke is not generated in defined areas. Such restrictions include designated "no smoking" areas and the use of expensive room ventilation systems and the like to minimize secondary smoke. There is a significant need for a smoker's device which would allow the smoker to enjoy the pleasure of smoking without generating secondary smoke and affecting others who might find it objectionable.

Secondary smoke is generated in a number of ways during the smoking process. Secondary smoke is principally comprised of sidestream smoke which is generated by a burning cigarette between puffs. Other contributions to sidestream smoke include mainstream smoke spillage from the smoker's mouth and exhaled smoke. A number of prior proposals have been made with respect to structures designed to minimize or eliminate the formation of secondary smoke. Such prior proposals have tackled the major source of cigarette smoke, namely the sidestream smoke and exhaled smoke and to some extent the mainstream smoke spillage. Various prior art efforts have been made to either capture in some form of container, secondary smoke or to filter secondary smoke before release to the surroundings. Examples of such prior devices are described in U.S. Pat. Nos. 4,198,992; 4,200,114; 4,637,407; 4,790,332; 4,899,766; 4,993,435; 5,048,845; 5,160,518; 5,497,791; 5,495,859 and Japanese application HEI3-177280 published Apr. 27, 1993.

Several of these devices employ fans with filter arrangements or container systems to trap secondary smoke before it is released to the surroundings. Usually the fan arrangements are designed to capture the major component of secondary smoke, namely, sidestream smoke. The fan arrangements are designed to draw sidestream smoke from the burning end of the cigarette in a direction pointing away from the cigarette tip. Examples of such devices are described in the above namely, U.S. Pat. Nos. 4,637,407; 4,899,766; 5,048,545 and 5,497,791. Although systems offered by these U.S. Patents provide varying degrees of success in eliminating sidestream smoke, U.S. Pat. Nos. 4,899,766 and 5,048,545 are not hand-held, that is, the entire system is far too bulky to be carried around. The systems of U.S. Pat. Nos. 4,637,407 and 5,497,791 are hand-held but bring with the design, due to its compact nature, significant design constraints in order to achieve sidestream smoke filtration. The system of U.S. Pat. No. 5,497,791 is very effective in this regard but presents certain design restrictions in achieving sidestream smoke filtration, such as build-up of heat in the filter system and the momentary resistance to sidestream smoke flow over the burning ash during each puff on the cigarette.

It is therefore an object of an aspect of this invention to provide a combustion chamber for a hand-held cigarette smoke filtering device for filtering sidestream smoke in a very efficient manner while taking advantage of the normal direction of flow of cigarette smoke towards the cigarette tip during the smoking process as well as the natural rise of heat from the cigarette. It is also an object of an aspect of the invention to provide a filter design which inherently cools the sidestream smoke before it passes through the filter system. In accordance with an aspect hereof, a plenum may be used to connect combustion chamber to sidestream filter. It is also another object of an aspect of the design to provide a sidestream smoke filtration system which avoids the collection of cigarette ash in the filter system.

SUMMARY OF THE INVENTION

In accordance with an aspect of the invention, a cigarette combustion unit for use in a hand-held cigarette smoke filtering device for filtering sidestream smoke emitted from a cigarette burning in said unit comprising:

i) an elongate closed combustion chamber in which a burning cigarette is located, a lower wall portion of said combustion chamber below a burning cigarette at least having an air porous portion to permit air to enter said combustion chamber;

ii) a cigarette holder in an end of said combustion chamber for holding a burning cigarette in said combustion chamber with its burning end spaced from chamber interior wall surfaces and above said air porous portion; and iii) a sidestream smoke outlet in said end above said cigarette holder whereby smoke from a burning cigarette is directed along a burning cigarette and out of said combustion chamber through said outlet.

In accordance with another aspect of the invention, in combination, a cigarette combustion unit, a sidestream smoke filtering device and a plenum interconnecting said cigarette combustion unit with said filtering device, said combination comprising:

i) an elongate combustion chamber having an open end for receiving a lit cigarette, a lower wall portion of said combustion chamber at least having an air porous portion to permit air to enter said combustion chamber;

ii) a plenum connected to said open end of said combustion chamber;

iii) a cigarette holder extending through said plenum to support a lit cigarette in said combustion chamber;

iv) said plenum having a sidestream smoke inlet in communication with said combustion chamber, said plenum having and outlet for sidestream smoke spaced from said inlet;

v) said sidestream smoke filtering device being connected to said plenum outlet.

In accordance with another aspect of the invention, a plenum for use in connecting a cigarette combustion chamber to a sidestream smoke filtering device, said plenum comprising:

i) an elongate box;

ii) a cigarette holder extending through said box;

iii) a sidestream smoke inlet above said cigarette holder and in an inside wall of said box, iv) a sidestream smoke outlet spaced from said inlet and in said inside wall, v) means for connecting a combustion chamber to said inside wall to seal said inlet with combustion chamber interior;

vi) means for connecting a filtering device to said inside wall and seal said outlet with said filter device; and vii) means for connecting said plenum to a hand-held cigarette smoke filtering unit.

BRIEF DESCRIPTION OF THE DRAWINGS

Preferred embodiments of the invention are described with respect to the drawings wherein:

FIG. 1 is a top plan view of the smoking device with the end cap removed;

FIG. 2 is a side view of the smoking device of FIG. 1;

FIG. 3 is an end view of the smoking device of FIG. 1;

FIG. 10 is a section along the lines AA of FIG. 1;

FIG. 11 is a section along the lines BB of FIG. 1;

FIG. 12 is a section along the lines EE of FIG. 1;

FIG. 13 is a section along the lines CC of FIG. 1;

FIG. 14 is a section along the lines DD of FIG. 1;

FIG. 15 is a top plan view of the sidestream combustion chamber filter device;

FIG. 16 is a rear elevation of the plenum for the combustion chamber filter device;

FIG. 17 is a front elevation of the interior or the plenum of FIG. 10;

FIG. 18 is a side view of the combustion chamber filter device with the filter in the foreground;

FIG. 19 is a section along the lines AA of FIG. 17;

FIG. 20 is a section along the lines BB of FIG. 15;

FIG. 21 is a section along the lines CC of FIG. 15;

FIG. 30 is a top plan view, partially sectioned of an alternative embodiment for the combination combustion chamber, plenum and sidestream smoke filter;

FIG. 31 is a section along the lines AA of FIG. 30;

FIG. 32 is a section through the combustion chamber liner, plenum and sidestream smoke filter with an alternative embodiment for the cigarette holder; and FIG. 33 is a section through the plenum showing an alternative embodiment for coupling the filter to the plenum.

DEFINITIONS

Figure 4:
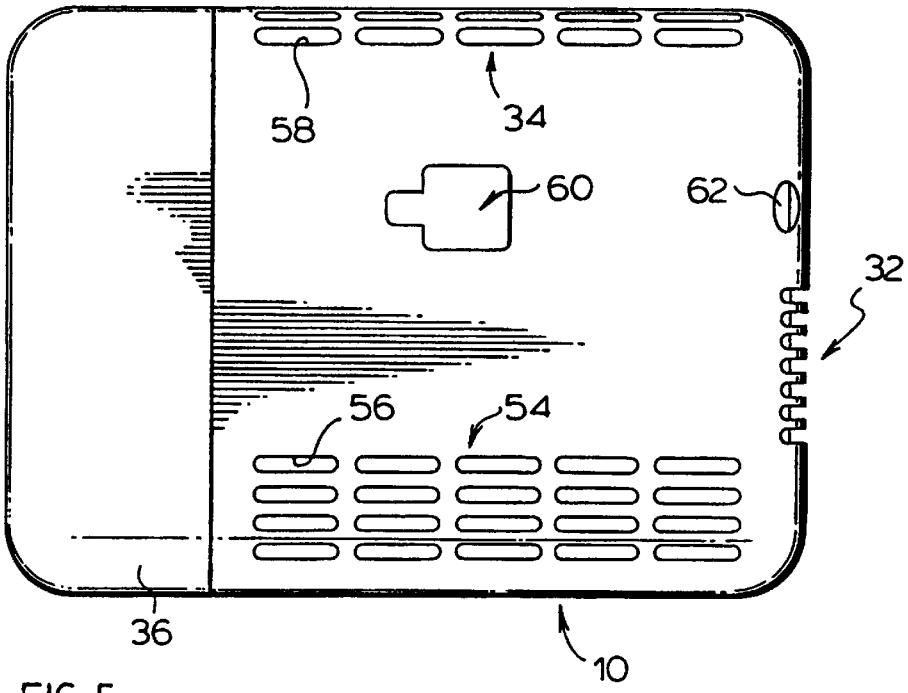
FIG. 4 is a bottom plan view of the device.

In order to facilitate discussion of the various embodiments of the invention, the following definitions are provided:

Exhale Smoke means cigarette smoke exhaled by a smoker while smoking a cigarette.

Gaseous Components means the components of cigarette smoke other than particulate components.

Low Pressure Drop means that the material is sufficiently porous to air flow that a pressure drop across the material is sufficiently low that the size of the fan, the power therefor, the exhale pressure are of a nature that the smoker's accessory may be hand held. In order to optimize the design, a low pressure drop is preferably less than about 10 mm $H_2O$.

Micro-fibres means fibres having an average diameter of about 10 microns or less.

Minimal resistance to air flow means that the filter material or the like provides a very low pressure drop to air passing therethrough.

Non-Porous means that the material does not permit flow of the designated components through the material. For example, if a material is non-porous to smoke particles then smoke particles are prevented from traveling through the material but for example, air could continue to travel through the material.

Particulate Components means the visible and non-visible components of cigarette smoke which exist in particle form and are usually of a size less than 1 micron and normally of a size in the range of about 0.1 and about 0.6 microns.

Porous means that the material is sufficiently open with holes, channels or the like to permit air to flow therethrough.

Sidestream Smoke means cigarette smoke which rises from a lit cigarette.

Substantially All means in respect of removal of particulate components or gaseous components from cigarette smoke so that there are substantially no visual or gaseous components remaining which smell like cigarette smoke.

Suitable Micro-Fibre Forming Composition includes any material which can be formed into micro-fibres and when contacted by cigarette smoke, retains its structure and functional characteristics.

Tube or Tubular means an elongate hollow article which has a sidewall of any desired cross-sectional shape, such as, circular, rectangular, square, triangular, oval, multisides (5 sides or greater) and the like.

DETAILED DESCRIPTION OF THE PREFERRED EMBODIMENTS

The cigarette smoke filtering device in accordance with this invention must be of a hand-held size to facilitate the smoker's use of the device. The device must be portable so that a smoker can have the device on hand at all times to permit smoking of a cigarette in areas where others might find secondary cigarette smoke objectionable. In making a cigarette smoke filter device of hand-held size, significant demands are placed on the design in dealing with the quantity of secondary smoke to be filtered and temperatures within the unit, to provide a normal feel to the smoker in respect of puffing on the cigarette and normal taste and flavour of the inhaled smoke and normal exhale. The smoke filtering device of this invention provides these features while accommodating various lengths of cigarettes to be smoked including the popular 100 mm cigarette. The device also effectively handles sidestream smoke emitted from a burning cigarette to provide a cool smoke with extended filter life and avoiding the ash from the burning cigarette interfering with the filter. The device also provides for the incorporation of a cigarette lighter to light a cigarette, where it may be inserted in the unit without increasing the overall size of the hand-held cigarette smoke filtering device. A "press and hold" button may be used to cause an element to glow and thereby lights the cigarette. The internal lighter may be mounted on adjustable brackets to allow for use of different cigarette lengths. In accordance with a preferred aspect of the invention, the footprint of the hand-held device approximates the size of a large size 25 cigarette package commonly sold in Canada. Hence, the device may be readily carried in one's pocket or purse without causing the user any significant inconvenience.

The cigarette smoke filtering device of FIG. 1 is equipped to filter sidestream smoke from a burning cigarette and to filter smoke from user's exhale. The device 10 has a main body portion 12 where in sector 14, a cigarette combustion unit comprising a combustion chamber and filter arrangement is provided to remove sidestream smoke and in sector 16 is the filter for removing exhale smoke. With a cigarette inserted in the device 10, a cigarette tip which is normally in the form of the filter element 18 extends beyond the device to allow a user to puff on the cigarette. A mouthpiece 20 is provided on the device which may be rotated 180° to allow a user to place readily their mouth on the mouthpiece 20 and exhale into the device so that exhaled smoke is filtered. As will become apparent from a discussion of the following Figures, a plenum 22 is provided which functions to in this embodiment, close off the open end of the combustion chamber and transfers sidestream smoke from the combustion chamber to the sidestream filter. An appropriate cigarette holder 24 may be provided in the plenum to position and support the cigarette in the combustion chamber. The plenum 22 with cigarette holder 24 may be removable from the device to facilitate changing of a liner in the combustion chamber and replacing the sidestream filter. Similarly, a holder 26 for an exhale filter is removable from the device along with mouthpiece 20 to allow replacement of the exhale filter. Batteries for powering the fan used to withdraw sidestream smoke from the combustion chamber are contained in the device and a cap 28 is provided on the device which may be removable to allow battery replacement. A suitable vent 30 is provided in the body portion 12 above the combustion chamber to allow outside air to rise over the liner in the chamber to provide additional cooling. The fan exhausts the filtered air through an exhaust grill 32. An exhale grill 34 is provided in the body portion 12 through which filtered exhale air travels. With the mouthpiece 20 turned inwardly, an end cap 36 may be positioned over the end generally designated 38 of the device to cover the plenum 22 and mouthpiece 20 by friction fit over the shoulder 40. With the end cap 36 in place, a smoothly formed elegant design is provided.

As shown in FIGS. 2 and 3, the body portion is stepped to provide a thicker sector 14 and a thinner sector 16. The thicker sector 14 accommodates the combustion chamber and sidestream smoke filter whereas the thinner sector 16 accommodates the exhale filter. The cigarette holder 24 is shown in more detail in FIG. 3. The cigarette holder comprises an annular ring 42 with spaced apart inward projections 44. The inward projections 44 define a locus of points having a diameter slightly less than the size of the cigarette. The projections 44 facilitate insertion of the cigarette into the cigarette holder by slightly compressing the cigarette at points about its circumference to allow the cigarette to be inserted in the holder 24 while at the same time supporting the position of the cigarette in the combustion chamber. The cigarette holder preferably has between projections 44, openings 46 which extend longitudinally in the direction of the axis 48 of the cigarette. This allows air to be drawn into the plenum 22 by the power of the fan and thereby provide a cooling effect over the filter tip 18 of the cigarette positioned in the holder 24. Also as shown in FIG. 3, the mouthpiece 20 has tapered sections 50 with an opening 52 to provide the desired degree of comfort for the user placing their mouth over the mouthpiece 20 to exhale into the device 10.

FIG. 4 shows the air inlet vent system 54 on the underside of the device 10 for supplying air from the underside of the device into the bottom of the combustion chamber sector. The vent system 54 consists of a plurality of slots 56 extending longitudinally of the device. They may be similar in shape to the slots 58 which form the vent 34 for the exhale filter. The overall shape of the device is shown in FIG. 4 where the end cap 36 is in place. Readily accessible on the underside of the device 10 is the on/off switch 60. Also, at the bottom end of the device is an opening 62 to receive a battery charging plug.

Figure 5:
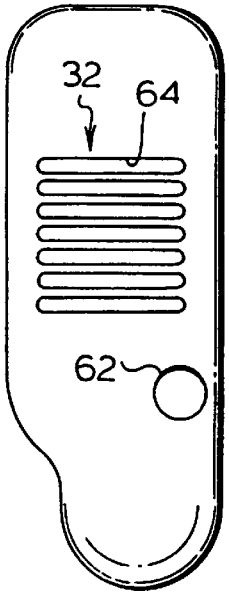
FIG. 5 is a rear end view of the device.

The bottom end view of FIG. 5 shows the grill work 32 having individual slots 64 extending across the bottom end from which filtered sidestream smoke is exhausted by a fan located in a fan chamber behind the grin 32.

The section of FIG. 10 shows a side elevation of the combustion chamber which as will become apparent from the discussion of the following Figures is somewhat oblong in cross-section, that is, considerably narrower in its width than in its height. The combustion unit has the outer shell 64 of the body portion 12 in which the individual laterally extending slots 66 are provided for the upper grill 30. The outer shell also has the slots 56 provided along the bottom of the body portion 12. Air is drawn by fan through slots 56 in the direction of arrows 57.

The bottom end 68 of the device 10 is curved to the extent shown here and in FIG. 2. The purpose of the curvature is to ensure that when the user sets the device 10 down on a table or the like it will not stand on its end. Preferably, the device is set down with the bottom against the supporting surface. This ensures that the device cannot be knocked over which might upset and break components of the device and as well ensures a better orientation for the device in the event that a lit cigarette is left unattended in a device. Such orientation minimizes temperature build-up in the combustion chamber, as will become apparent in respect of the discussion of FIGS. 15 through 21.

The combustion unit sector 14 having the outer shell 64, also has an inner shell 65 located therein. The inner shell defines the combustion chamber. Preferably the plenum 22 is releasably secured to an open end of the inner shell 65. As will become apparent from the description of FIG. 12, the inner shell 65 has slots in its lower wall or bottom portion to allow air which passes through the slots 56 to then enter the combustion chamber. The combustion chamber shell 65 may also be permanently secured to the plenum 22 in accordance with alternative embodiments described with respect to FIGS. 30 and 31.

Figure 27:
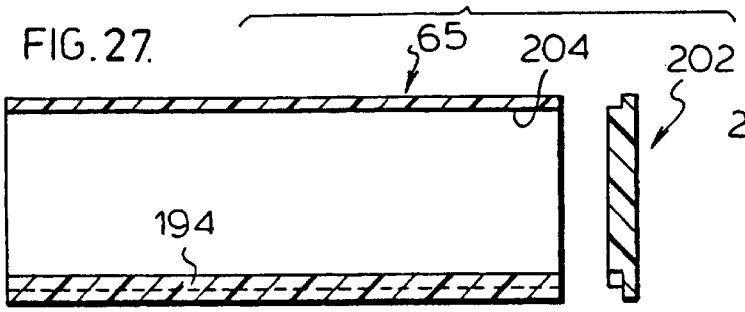
FIG. 27 shows an alternative embodiment for the liner of the combustion chamber having an end cap.
Figure 28:
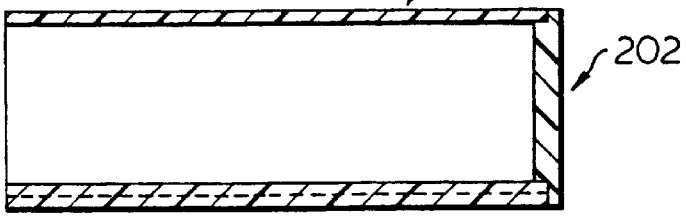
FIG. 28 shows the end cap assembled on the liner.

In accordance with a preferred embodiment of the invention, a liner 70 is provided for the interior of the combustion chamber 65. The liner 70 has a wall 72 of a suitable heat resistant material which is porous to the flow of air yet is non-porous to cigarette ashes. The combustion chamber 65 may optionally include an end cap 74 for the other open end of the inner shell 65. As will be later described with respect to FIG. 27, the chamber may be permanently closed depending upon the manner in which the combustion chamber 65 is attached to the device outer shell 64 or the plenum 22. The combustion chamber liner 70 may either be friction fitted to a suitable collar of the plenum 22 in which event the end of the liner may be sealed or the combustion chamber liner 70 may be sealed to the plenum 22 where the liner has an open distal end 71. These aspects of the invention will be described in more detail with respect to FIGS. 22 through 29.

Figure 6:
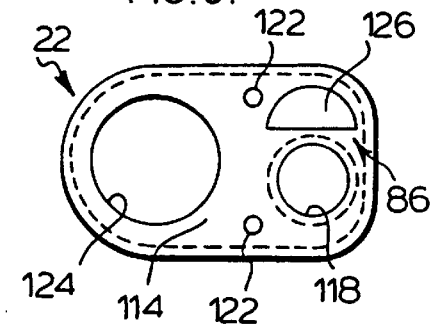
FIG. 6 is a rear plan view of the plenum.
Figure 8:
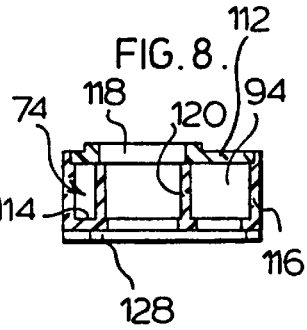
FIG. 8 is a section along the lines AA of FIG. 7.
Figure 7:
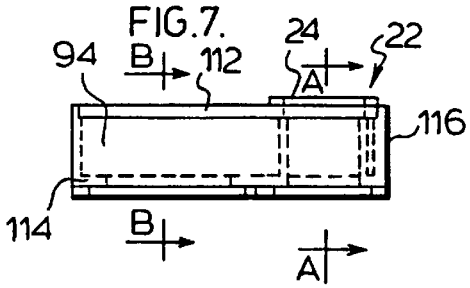
FIG. 7 is a top plan view of the plenum.
Figure 9:
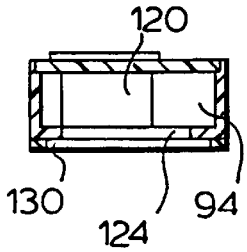
FIG. 9 is a section along lines BB of FIG. 7.

The cigarette holder 24 may be press fitted in the plenum 22 where the plenum 22 is a box-like structure to be described in more detail with respect to FIGS. 6 and 7. Although it is understood that if the combustion chamber 65 has its own end wall, the cigarette holder may be press fitted in a hole in the chamber end wall. The cigarette holder 24 has a body portion 74 with inwardly projecting ridges 42 to lightly squeeze the cigarette 76 about its perimeter and thereby support the cigarette in its extended fashion within the space 78 of the combustion chamber. The cigarette holder 24 may also include a bi-metallic ring 80 which has a laterally extending flap 82 outside of the cigarette holder 24. When the burning cigarette coal 84 reaches the bi-metallic ring 80 the flap 82 moves downwardly to indicate to the user the end of a cigarette.

The plenum 82 has an opening 86 through which sidestream smoke from the burning coal 84 passes as it flows towards the sidestream smoke filter generally designated 88 in FIG. 11. The sidestream smoke filter has a closed end 90 with preferably a tubular filter 92. The filter 92 has an annular portion 93 and is constructed to remove substantially all of the sidestream smoke which flows through the plenum chamber 94 and through the inlet 96 of the sidestream filter 88. In accordance with a preferred embodiment of this invention, the filter 92 may be constructed in the same manner as that described in applicant's U.S. Pat. No. 5,495,859. The annular filter element 92 may have an inner layer or layers of microfibre material 98 to remove particulate components from the sidestream smoke which include solids and aerosols. The process for forming such microfibres is described in applicant's Canadian Patent 1,057,924. The process by which the fibres are formed into a suitable layer is for example, described in Canadian Patents 1,278,659 and 1,311,889. The outer layer of the annular filter element 92 may comprise a layer or layers of activated carbon 100 to adsorb the gaseous components of smoke not trapped by the inner filter layer 98. It is also appreciated that the outer layer 100 may include or be made of other types of material for absorbing gaseous components such as zeolites, as described in U.S. Pat. No. 3,327,718 or to include catalyst for further treatment of the gaseous components. The activated carbon may be held in layer form by the use of a porous mesh or the like. The preferred outer filter element is made up of a sheet or sheets or activated carbon fibres which may be obtained from various sources of the supply, for example, from Futamura Chemical Industries of Nagoya, Japan. It has been found that this preferred combination of microfibres and activated carbon fibres provides a very effective filter element for removing substantially all of the sidestream smoke generated by the burning coal 84 of the cigarette 76. It is also appreciated that between the layers of the activated carbon fibre material, layers of other types of smoke treating agents may be included which may be in the form of powders of or the like. It is also appreciated that in view of the adsorbing nature of the carbon fibre material, treating agents may be included in the carbon fibre material to also treat the smoke before exhaust to atmosphere. Such treating agents include citric acid, fresheners and the like which perform different treatments than those achieved by the use of activated charcoal, zeolites, catalysts and fine fibre smoke filters.

The sidestream filter 88 is positioned in the body portion 12 within the shell 64. The outer circumference of the filter element may be secured or connected to the plenum 22 or removable therefrom in a manner to be discussed with respect to FIGS. 15 to 21. The plenum may be snap fitted over biforcated prongs 102 which are part of the top end of the device 10. The prongs will be described in more detail with respect to FIGS. 13 and 15 in respect of their interaction to mount releasably the plenum on the top end of the smoke filtering device. A suitable battery powered fan 104 is mounted at the exhaust end 106 of the device. The fan draws air through the slots 56 initially in direction of arrows 57 and through the slots in the combustion chamber shell 65 and the porous liner wall 72 to supply the necessary air to the burning coal 84 to support combustion and as well to remove the generated sidestream smoke from the combustion chamber through opening 86. The fan 104 then draws the sidestream smoke through the plenum chamber 24 and into the filter 88 through the inlet 96. The fan 104 has a motor 106 which is supported within the device by suitable support arms 108. The fan motor 106 drives a fan 110 at a sufficient speed to provide a necessary draw to pull all sidestream smoke from the combustion chamber 78 through the filter element and exhaust filtered air through grate 32. By virtue of the efficiency of the filter 88, substantially all sidestream smoke is removed from the flow of air so that the air exhausted through grill 32 does not carry any appreciable smell of cigarette smoke and preferably no smell of cigarette smoke. During the smoking process heat is generated in the combustion chamber 65. It is appreciated that the outer shell 64 of the combustion unit may be spaced from the combustion chamber shell 65 to ensure that the temperature of the outer shell is comfortable to the smoker. It is understood that air which enters the slots 56 may flow around the combustion chamber shell 65 and out through the upper slot 66. By increasing the spacing between the outer shell 64 of the combustion and the combustion chamber shell 65, sufficient air flow may be encouraged to keep the outer shell 64 at an acceptable, comfortable temperature.

Some very significant, unexpected advantages are realized in providing in combination, a combustion chamber, plenum and sidestream filter arrangement of this invention. The cigarette has the expected and the same desired taste, flavour and smoking temperature as a cigarette smoked under normal conditions. By directing the flow of air over the cigarette all of the gases which permeate the cigarette paper are gathered up in a flow of sidestream smoke through the opening 86 of the plenum. As the cigarette smoke flows through the plenum it is cooled down before entry into the sidestream smoke filter 88 so that the efficiencies of the sidestream smoke filter increase greatly. As ash falls from the burning coal 84 it is retained in the combustion chamber on the liner 72. Even though the liner 72 is quite porous to the flow of air, the pore openings are sufficiently small so as to be non-porous to cigarette ash. By precluding the cigarette ashes from entering the filter element 88, the efficiencies of the filter element are greatly increased to prolong its life and reduce the number of times the filter element has to be changed while smoking multiples of cigarettes.

A further aspect which is believed to contribute to the coolness of the smoke is that air is allowed to enter the openings 46 in the cigarette holder 24 and flow along the cigarette tip 18 and inwardly over the bi-metallic ring 80 and then immediately upwardly through the opening 86 in the plenum. The-draw of the fan 104 and the size of openings 46 is such to ensure that the flow of air is along the cigarette towards the bi-metahic ring 80 to prevent thereby any cigarette smoke escaping around the cigarette tip through the holder 24.

The provision of a plenum which provides mounting for the cigarette holder and a delivery of the cigarette smoke to the sidestream smoke filter is most advantageous in a compact hand-held cigarette smoke filtering device. The plenum 22 as shown in FIGS. 6 and 7 has a box-like structure with an inner chamber 94. The box-like structure has a front wall 112, an inner wall 114 and a circumferential wall 116. An opening 118 is provided in the outer wall 112. An integral collar 120 is provided in the chamber 94 and extends from the outer wall to the inner wall 114. The cigarette holder is then mounted through the opening 118 and press fitted into the collar 120 to keep the cigarette holder in place. On the inside wall 114 are two apertures 122 which snap fit over the biforcated prongs 102 provided on the front end of the body portion of the device 10. This holds the interface 114 against the front end of the body to ensure that cigarette smoke does not escape between the interface 114 of the plenum 22 and the front face of the body 12.

An aperture 124 is provided in the inner face 114 of the plenum 22 to allow smoke that has traveled through opening 86 and through the plenum chamber 94 to flow through the inlet 96 of the filter element. The opening 86 is preferably provided with a screen or some other suitable mesh 126 to prevent cigarette ashes from falling into the plenum 22 should the unit 10 be turned upside down. It is appreciated however that should some ashes fall into the chamber 94, it is not a significant problem so that the opening 86 may be left open if warranted. The inner wall 114 has an oblong-shaped shoulder portion 128 which snugly fits over the exterior of the end of the combustion chamber liner 70. Correspondingly, the inner wall 114 also has adjacent opening 124, a shoulder 130 which is circular in shape and snugly receives the exterior of the filter element 88. Such fitment will be described in more detail with respect to the various combustion chamber and filter arrangements of FIGS. 15 through 29.

The section of FIG. 12 shows the fitment of the combustion chamber shell 65 and inner liner 70 and filter element 88 on the plenum 22. The combustion chamber shell 65 is positioned in the cavity 132 defined within the shell 64 and by an inner partition 134. The slots 198 in the bottom of the combustion chamber shell 65 are shown by virtue of the cut-away of the liner element 70. The filter element 88 is positioned in the cavity 136, as defined between partition 134 and partition 138. The plenum 92 is mounted in place, as secured by the biforcated prongs 102. The fan cavity 144 has a fan inlet opening 140 in the wall 142. The batteries are positioned in cavity 146 where the end cap 28 may be removed to allow for replacement of the batteries. When rechargeable batteries are used, the recharging plug 148 is passed through aperture 62 and is plugged into the charger circuitry 150 which is controlled by the electronic component board 152. As shown in FIG. 13, the cavity 146 is defined between partitions 138 and 154. Beside partition 154 is the exhaled smoke filter element with its appropriate vents 54.

As shown in FIG. 13, the cavity 146 contains the batteries 156 which may be held in a suitable battery sleeve 158. Beneath the battery cavity 146 is a bottom wall 160 which supports the circuitry board 152 and as well the on/off switch 60. The charging circuitry 150 is connected to appropriate wires of the circuitry board 152 where the circuitry board 152 may control the charging of the batteries 156 or charging of the batteries may be controlled through an external component which is coupled to the charging plug 148 through suitable wires 162. The end cap 28 has a negative terminal 164 which is in contact with the circuitry board 152 through interconnecting terminal 166. The positive side of the battery arrangement is connected to the positive terminal 168 which in turn is also connected to the circuitry board 152 whereby through switch 60 the power to the fan is 104 is controlled for purposes of on and off. The circuit board 152 may also include a control circuit for maintaining constant speed of the fan 104. The fan speed may tend to vary due to change in temperature of the unit, for example, whether it is used inside or outside and heat from the smoking process may also tend to warm up the device. Since the speed of the fan determines the flow rate of air through the device, it is preferable to maintain a constant fan speed to ensure that optimum conditions are always provided in removing the sidestream smoke from the combustion chamber and ensuring that it is properly past through the sidestream smoke filter 88.

As shown in FIG. 14, the mouthpiece 20 is connected to an exhale filter element 170 by fitment within the connector 26. The filter element 170 may be the same as or function the same as that described in applicant's U.S. Pat. No. 5,495,859. The exhale filter element 170 comprises suitable filter medium which removes substantially all of the exhaled smoke so that little if any cigarette smoke can be smelled as it exhausts through the grill 54. The filter element 170 is contained within a cavity 172, as defined by the shell 64 and the internal partition 154.

The arrangement and relationship of the combustion chamber shell and liner, sidestream smoke filter and plenum will now be described with respect of FIGS. 15 through 29. The combustion chamber liner 70 may be fitted on or to the plenum 22 in a variety of ways to either facilitate removal of the combustion chamber liner from the plenum or to be permanently mounted to the plenum interior wall 114. In the embodiment shown in FIG. 15, the combustion liner wall 74 fits snugly within external shoulder 128. When it is desired to permanently secure the liner to the plenum, the liner wall at its peripheral edge 174 of the open end, may be glued or in some other way secured to the shoulder 128. As shown in FIG. 16, the combustion chamber liner 70 has along its underside a longitudinally extending rib 176 which supports the combustion tube liner above the bottom of the combustion chamber by resting on the interior of the combustion chamber shell 65. This ensures that the underside 178 of the combustion chamber liner is spaced upwardly from the slots 198 to readily allow air to enter in the space beneath the combustion chamber liner. The flow of this air in providing for removal of sidestream smoke will be discussed in more detail with respect to FIG. 20. In addition, the oblong cross-sectional shape for the combustion chamber shell is advantageous in providing more space above the cigarette. Hence, the cigarette holder 24 is positioned in the lower portion of the plenum 22 so as to position the cigarette in the lower portion of the combustion chamber. In this particular embodiment as shown in FIG. 18, the combustion chamber liner which is the same cross-sectional shape of the shell 65, may be of the same height as the diameter of the sidestream smoke filter.

In accordance with this invention by providing a combustion chamber separate from the filter chamber which carries out the filtering of sidestream smoke, the length of the combustion chamber may be greatly increased to readily accommodate varying size cigarettes, including cigarettes up to 100 mm in length. Preferably, the end 74 of the combustion chamber shell is closed off so as to prevent ashes from escaping the liner and falling onto the interior of the shell 65 and hence, perhaps falling out of the unit through the slots 56. In the event that the liner end 74 is sealed permanently, then the combustion chamber liner 70 is preferably removable from shoulder 128 of the plenum 22 to allow dumping from time to time of ashes from within the combustion chamber liner. It is expected that ashes should be dumped from the combustion chamber liner two or three times during the smoking of an entire package of cigarettes. Preferably, the filter 58 is constructed of suitable filter material which is expected to last for 1 or 2 packages of cigarettes before replacement is required.

As shown in FIG. 19, the shoulders in which the combustion chamber liner 70 and the filter 88 are fitted are aligned and flush so as to fit tightly against the front face 180, as shown in FIGS. 10 and 11 and thereby seal the interior face of the plenum defined by the shoulders 128 and 130 against the front face 180 of the device. The biforcated prongs 102 ensure that the plenum remains against the front face of the device so that all sidestream smoke to be filtered from the burning cigarette passes from the combustion chamber into the sidestream filter.

As described with respect to FIGS. 10, 11 and 12, the fan 104 is operated at a speed to draw sufficient air in through the slots 56 and 198 in direction of arrow 57 to provide a sufficient flow of air over a burning cigarette 76 to carry all sidestream smoke into the plenum 22 through the opening 86. As shown in FIG. 20, the combustion liner 70 is sufficiently porous to air to allow the air to permeate readily through the liner in a direction of arrows 182. The air readily permeates upwardly through the entire lower region 178 of the liner to ensure a sufficient flow of air over the cigarette to supply the necessary oxygen in the air to support combustion of the burning coal 84 and to carry away from the cigarette, sidestream smoke rising in the direction of arrows 184 from the burning coal 84. When the burning cigarette is idle, the air which permeates the liner in the direction of arrow 182 flows over the cigarette in the direction of arrows 186 particularly in the region of the burning coal 84 to carry away the sidestream smoke. The sidestream smoke is carried along the cigarette in the direction of arrow 188 which is the same direction as the mainstream smoke flows when a smoker inhales on the tip 18 of the cigarette. As the smoke approaches the plenum 22, it gathers and flows in the direction of arrows 190 through the opening 86 into the plenum chamber 94. At the same time, air which enters through the openings 46 about the cigarette holder flows over the bi-metallic ring 88 and upwardly through the opening 86 in the direction of arrow 192. The oblong shape for the combustion chamber provides considerable space above the burning coal 84 to allow the heat to rise with the smoke and be carried in the normal smoking direction 188 towards the plenum 22. By providing slots 198 only in the bottom of the combustion chamber shell 65, all sidestream smoke is encouraged to flow along the liner 70 towards plenum 22. It is believed that carrying the sidestream smoke and heat in the normal smoking direction 188 more closely resembles what happens during the normal smoking process as vapours or the like tend to rise through cigarette paper of the cigarette 76. The vapours are immediately cleared in the direction of arrows 186 and 190 into the plenum chamber 194. This avoids having to draw the vapours which rise through the cigarette paper during the puffing action over the region of the burning coal 84. When a cigarette smoker puffs on the cigarette, the burning coal 84 rapidly rises in temperature giving off considerable heat. Pulling of the vapours rising through the cigarette paper over and through the coal region requires considerably higher fan speed and as well heats up these vapours as they pass over the burning coal 84. Instead, by drawing air up through the combustion chamber liner over the burning coal and then along the cigarette in the normal smoking direction 188, a somewhat more natural environment is provided for the burning of the cigarette to optimize on flavour, taste and burning characteristics of the cigarette.

As the air moves with the sidestream smoke into the plenum chamber 94 and flows toward the inlet 96 of the sidestream smoke filter 88, the plenum chamber 94 serves to cool the smoke before entering the sidestream smoke filter 88. Furthermore, in providing a considerable space above the cigarette in the combustion chamber and increased flow of air along the entire bottom of the combustion chamber liner, the sidestream smoke is naturally cooler. The additional cooling in the plenum 22 provides for optimal efficiencies of the sidestream smoke filter 88 because the filter is cooling sidestream smoke before exhausting through the vent 32 of the device. In providing an oblong cross-sectional shape for the combustion chamber, the temperature of the inhaled smoke is the same as the normal temperature of inhaled smoke when smoking a cigarette in a totally open environment.

It is appreciated from this discussion of the combustion chamber liner that the liner's purpose is to diffuse and provide for a flow of air over the cigarette while at the same time retaining the ash from the burning cigarette. The combustion chamber shell does not necessarily have to include a liner, instead the combustion chamber may include a suitable screen over the slots 198 to prevent ash from falling out of the combustion chamber shell thereby avoiding a need for a liner. Whether it be the screen design for the slots 56 or for the liner 70 design, a degree of pressure drop is required to diffuse and to some extent restrict the flow of air into the combustion chamber. The pressure drop also minimizes outward flow of hot air particularly when the smoker puffs on the cigarette. The temperature of the burning coal may increase by 200 to 300' C. when the cigarette is puffed. Such rapid rise in heat could cause a momentary outward flow of sidestream smoke. However, with the combustion chamber liner 70, sufficient pressure drop is provided to prevent that outward flow of sidestream smoke back out of the combustion chamber. It is also understood that the circuit board 152 may include an addition to the fan speed controller, an additional fan speed override which momentarily increases fan speed when a cigarette puff is sensed. Such additional control can avoid escape of sidestream smoke immediately after each cigarette puff.

Figure 22:
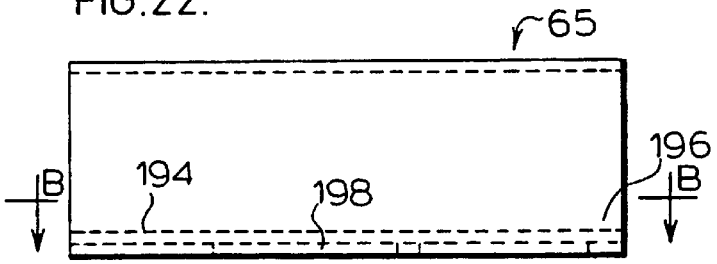
FIG. 22 is a side view of the combustion chamber liner.
Figure 24:
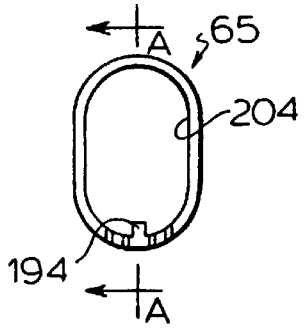
FIG. 24 is an end view of the combustion chamber liner.
Figure 23:
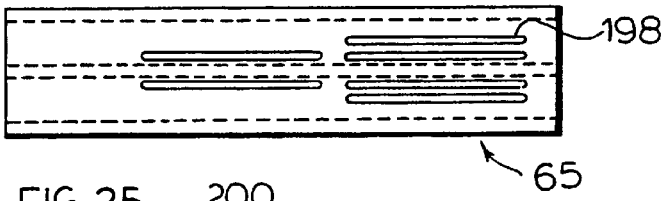
FIG. 23 is a bottom view of the combustion chamber liner.
Figure 25:
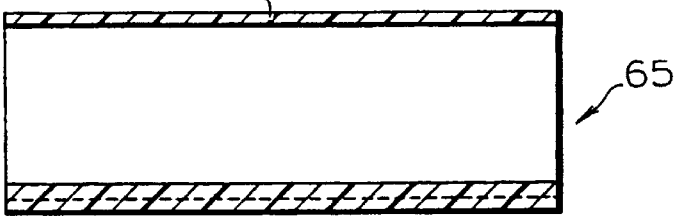
FIG. 25 is a section along the lines AA of FIG. 24.
Figure 26:
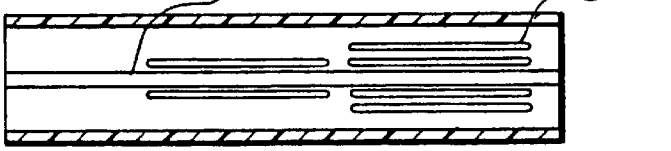
FIG. 26 is section along the lines BB of FIG. 22.

The combustion chamber shell 65 as shown in FIGS. 22, 23 and 24 has the oblong cross-sectional shape as shown in FIG. 24 where the shell has at its base an inwardly directed rib 194. In addition, the shell has formed in its lower region 196 the plurality of narrow longitudinally extending slots 198. The slots permit the flow of air upwardly into the combustion chamber space 78 to carry away the sidestream smoke. The shell 65 has a wall portion 200 which may be constructed of fire resistant plastic or some other suitable material such as ceramic which may be in the form of fibres constructed into a paper-like material. Preferably, the liner 70 is provided in the shell 65. The liner is of a carbon paper construction which is sufficiently porous to allow flow of air through the liner material with minimal pressure drop but at the same time contain the cigarette ash. The carbon paper is formulated in a way to resist charring or burning at the normal smoking temperatures of the cigarette.

Figure 29:
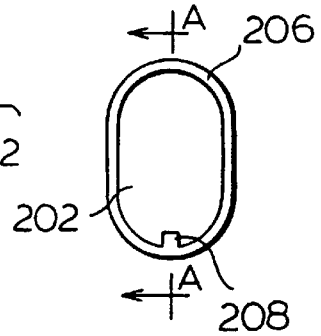
FIG. 29 is an end view of the cap for the combustion tube.

The combustion chamber shell 65, if permanently secured to the plenum may have a removable end cap 202 which friction fits within the interior 204 of the combustion chamber. The cap 202, as shown in FIG. 29, has a shoulder 206 which is consistent with the thickness of the combustion liner material 200. With a notch 208 at its based to accommodate the rib 194, the end cap 202 then snugly fits within the combustion shell 65 in the manner shown in FIG. 29 to temporarily seal off the end of the combustion shell. This allows one to remove the plenum from the front face of the filtering device and readily withdrawn from the device 10. In order to dump the ashes from the combustion chamber 78, the end cap 202 is removed, the ashes then tapped from the liner open end and the end cap 202 replaced so that the complete combustion chamber, plenum and filter can be reinserted in the device 10. The front face of the device, has apertures in the outer shell 64 to receive readily the shapes of the combustion chamber shell 65 and the sidestream smoke filter to facilitate easy entry and exit of the combustion chamber and filter arrangement and snap fitting of the plenum over the biforcated prongs 102.

An alternative embodiment for the combustion chamber is shown in FIG. 30. The combustion chamber shell 210 is made of a ceramic fibre material which is formed into a sheet and resembles paper in texture. The combustion chamber shell 210 is similar in shape to the combustion shell 65 of FIG. 10. The combustion chamber shell 210 may have its end portion 212 either secured to the plenum 22 or releasably fitted to the face of the plenum 22 in the same manner as the combustion chamber shell 65. The combustion chamber shell has a liner 214 which only covers the bottom portion 216, as shown in FIG. 31. The liner 214 may be of the carbon fibre material or of other suitable material to diffuse air flowing upwardly through the slots 218 in the combustion chamber shell and at the same time retain ashes within the combustion chamber 220. In the embodiment where the combustion chamber shell 210 is secured to the plenum 22, the end cap 222 for the combustion chamber shell may be removable to permit dumping from time to time of ashes from within the combustion chamber 220. It is appreciated that the liner strip 214 need only extend over the slots 218 and be secured in some manner to the interior of the combustion chamber shell to ensure that ashes do not find their way onto the slots 218. It is also appreciated that the ceramic fibre material for the combustion chamber shell may have an increased level of porosity in its lower portion 216 to replace the slots 218. In this arrangement, the liner strip 214 may not be required because the modified porosity in the base of the ceramic combustion chamber is sufficient to allow the required passage of air but at the same time preclude escape of ashes. As with the embodiment for the other combustion chambers, the ceramic combustion chamber may have a tab portion 224 which spaces the liner 214 from the slots 218 to ensure that the air flows underneath the liner strip 214 and diffuses upwardly therethrough to supply the necessary air for the burning cigarette.

An alternative embodiment for the cigarette holder is shown in FIG. 32. The cigarette holder 226 comprises concentric rings 228 and 230. A bore 232 is provided in the plenum which has inwardly directed ribs 234 of the same type as described with respect to FIG. 3. The ribs 234 hold the outer ring 228 in position within the plenum and as well provide a space 236 between each adjacent pair of ribs 234 to allow air to enter along the cigarette holder 226 be mixed with the sidestream air and flow into the plenum 22. The cigarette holder 222 has an inner ring 230 of fibrous material, preferably of carbon fibre material. The carbon fibre material readily adsorbs any condensation or moisture that comes out of the cigarette and may deposit on the holder 226. This is advantageous over the metal ring 80 of FIG. 10, which has a tendency to cause cigarette components to deposit out on the ring and hence, stain the cigarette when it is withdrawn from the device. Also, if the cigarette is smoked down to the ring, the deposited components can be revolitized and effect the taste of the cigarette during its last puff. On the other hand, the fibrous carbon material of the inner ring 230 avoids this difficulty.

The outer ring 228 may be formed of a suitable support, such as ceramic, fire resistant papers and the like. The preferred material for the outer ring 228 is the ceramic fibre paper. The outer ring 228 is sufficiently flexible to be slightly squeezed by the ribs 234 to allow placement of the ring 226 within the plenum bore 232. The outer ring 228 is fire resistant to prevent ignition of the ring as the cigarette burning ember approaches the ring 226. In addition, the ring 226 may be dimensioned to extinguish the cigarette as the burning ember approaches the ring to ensure that the cigarette does not burn through to the outside part of the ring 226.

As an alternative embodiment for the cigarette holder 236 with the inner ring 230 of activated charcoal material, the ring includes an outer annular body portion 242 which includes a board 238 to receive the cigarette with a lead in portion 240. Bore 238 includes ribs which lightly compress the cigarette as it is inserted through the inner ring 230. The flexibility in the charcoal material compensates for variations in cigarette diameters.

The device for connecting the inside wall 244 to the sidestream smoke filter 88 is shown in FIG. 33. The connecting device includes an annular shoulder 246 which has threads 248. The sidestream smoke filter 88 has an end cap 250 with a threaded shoulder 252 which engages the threads 248 to couple the sidestream smoke filter 88 to the plenum 22. When it is desired to replace the sidestream filter it is simply unthreaded and a new filter threaded in place. The threaded body portion 250 may stay with the unit and a new filter inserted and friction fitted within the rim 254.

It is appreciated that the plenum 22 may also be formed of a suitable biodegradable material. the material may be a plastic or other fibrous construction, for example, the ceramic fibre paper. When the combustion chamber shell, plenum and sidestream smoke filter are made as an integral unit for purposes of throwaway when the useful life of the filer is finished, the product is of a biodegradable material so as to be in keeping with environmental concerns. When the plenum is made of a ceramic type paper, it is understood that the surface of the paper may be finished to enhance the overall appearance of the plenum on the device.

In view of the various described embodiments for the combustion chamber, it is understood that the combustion chamber may be simply the shell component adapted with slots and suitable vent arrangements to function in a manner similar to the embodiments described with respect to FIGS. 10 and 30. Alternatively, the outer body shell 64 of the device may be properly constructed to perform and function in the manner of the combustion chamber shell. Alternatively, the preferred embodiment includes an outer shell with an inner combustion chamber shell and a liner to provide all of the advantages and features of this invention. Where the combustion chamber shell is preferably of ceramic paper and the combustion chamber shell is lined with a charcoal fibre strip which only covers the slots within the combustion chamber.

The device 10, with a combustion chamber, plenum and sidestream smoke filter all in communication, provides many advantages in achieving the desired goal of removing substantially all sidestream smoke. The oblong cross-sectional shape for the combustion chamber allows for the natural rise of heat from the cigarette and thereby allows the cigarette to burn in a natural manner by directing the flow of air as it gathers up the sidestream smoke, in the same direction as the flow of mainstream smoke. Lower air volume and velocity is needed to remove the sidestream smoke while particularly avoiding the momentary air block that is created by the burning cone when the smoker inhales on the cigarette. Furthermore, the liner or the combustion chamber itself is designed to provide a slight pressure drop to resist the flow of excess smoke at the end of each puff back out of the combustion chamber. The openings in the bottom of the combustion chamber and/or combustion liner, allow the air to flow readily into the combustion chamber to provide for free burn of the cigarette and sidestream smoke removal. The preferred liner, which may be of activated charcoal, keeps the combustion chamber clean and at the same time provides an initial adsorption of cigarette smoke constituents from the sidestream smoke. There are many options in mounting the liner on the plenum where the liner can be of extended length to accommodate longer cigarettes and readily accommodate the use of a lighter for a cigarette inserted in the combustion chamber. Ashes are contained in the liner which may be readily removed by simply pulling the plenum off of the front end of the device. The combustion chamber liner being separate from the filter and interconnected by a plenum provides for may options in smoker filtration device design including the very beneficial cooling action in the plenum on the flow of sidestream smoke. The reduction in temperature of the sidestream smoke before entering the filter greatly enhances the efficiency of the sidestream smoke filer.

It is also understood that the electronic aspects of the device may be programmed or modified to provide other features. The circuitry board 152 may be adapted to track battery charge status and display battery charge status during charging. In addition, the battery power may be displayed for five seconds whenever the unit is switched on or off. The battery charging may use a negative slope approach which is backed up with suitable protection circuit. In addition, the system may interrupt battery pack charging if the temperature of the batteries rises over the allowed limited. In order to prolong the life of the batteries, the circuit 152 may be programmed to only allow charging of the batteries if the capacity is less than 50%. Only in exceptional circumstances could this be overridden by the user by pushing a suitable button. It is already discussed with respect to the fan speed the circuit 152 may be programmed to drive digitally the fan and provide precise control of fan speed.

Although preferred embodiments of the invention have been described herein in detail, it will be understood by those skilled in the art that variations may be made thereto without departing from the spirit of the invention and the scope of the appended claims.

What is claimed is:

1. In combination, a cigarette combustion unit, a sidestream smoke filtering device and a plenum interconnecting said cigarette combustion unit with said filtering device, said combination comprising:

i) an elongate combustion chamber having an open end for receiving a lit cigarette, a lower wall portion of said combustion chamber at least having an air porous portion to permit air to enter said combustion chamber;

ii) a plenum connected to said open end of said combustion chamber;

iii) a cigarette holder extending through said plenum to support a lit cigarette in said combustion chamber iv) said plenum having a sidestream smoke inlet in communication with said combustion chamber, said plenum having an outlet for sidestream smoke spaced from said inlet, v) said sidestream smoke filtering device being connected to said plenum outlet.

2. A hand held sidestream smoke filtering unit including said combination of claim 1, said hand held unit having a fan for drawing sidestream smoke from said chamber, through said plenum and through said filter, said plenum cooling sidestream smoke before entry to said filter.

3. A combination of claim 1, wherein said filtering device is tubular, with an inlet at its open end which is in communication with said plenum outlet.

4. A combination of claim 3, wherein said tubular filter device is threaded onto said plenum.

* * * * *